US005086316A

United States Patent [19]

Aoki

[11] Patent Number: 5,086,316

[45] Date of Patent: Feb. 4, 1992

[54] LIFTING THE PHOTOSENSITIVE BODY IN AN IMAGE FORMING APPARATUS

[75] Inventor: Hideo Aoki, Yokohama, Japan

[73] Assignee: Ricoh Company, Ltd., Tokyo, Japan

[21] Appl. No.: 377,901

[22] Filed: Jul. 10, 1989

[30] Foreign Application Priority Data

Jul. 14, 1988 [JP] Japan ..... 63-173748

[51] Int. Cl.[5] ..... G03G 15/00

[52] U.S. Cl. ..... 355/200; 355/202; 355/211; 355/308

[58] Field of Search ..... 355/200, 202, 211, 210, 355/308

[56] References Cited

U.S. PATENT DOCUMENTS 4,616,920 10/1986 Itoigawa et al. ..... 355/200
4,634,264 1/1987 Takahashi ..... 355/200
4,873,548 10/1989 Kobayashi et al. ..... 355/200
4,876,572 10/1989 Nagatsuna ..... 355/210

*Primary Examiner*—A. C. Prescott
*Attorney, Agent, or Firm*—Cooper & Dunham

[57] ABSTRACT

A xerographic image forming apparatus comprises a top cover lid member provided above the photosensitive body so as to be opened and closed, a movable supporting part provided on the top cover lid member so as to be movable between a first position and a second position relative to the top cover lid member, in which the movable supporting means is adapted for engagement with the photosensitive body and selectively assumes a first position in which the movable supporting means does not engage with the photosensitive body and a second position in which the movable supporting means engages with the photosensitive body responsive to opening of the top cover lid member, and a fixed supporting part provided on a body of the xerographic image forming apparatus for supporting the photosensitive body.

11 Claims, 3 Drawing Sheets

LIFTING THE PHOTOSENSITIVE BODY IN AN IMAGE FORMING APPARATUS

BACKGROUND OF THE INVENTION

The present invention generally relates to image forming apparatuses and more particularly to a xerographic type image forming apparatus.

Recent xerographic image forming apparatuses used in electrostatic photocopier, laser printer, facsimile apparatus and the like have an improved design for facilitating maintenance. Particularly, the apparatus is improved for easiness in removing jammed papers from the apparatus such that a user can do such removal by himself without difficulty. For example, there is a so-called upper transport path type apparatus in which a paper to be printed with an image is transported along a paper transport path passing at an upper side of a photosensitive drum body wherein a top cover lid is provided for accessing the paper in the paper transport path. By simply opening the top cover lid, the user can expose the paper transport path whenever the paper is jammed in the apparatus. Thus, the xerographic image forming apparatus having such a construction is quite easy for removal of the jammed paper.

However, such a prior art xerographic image forming apparatus has a problem in that replacement or cleaning of the drum body is difficult as the drum body is provided inside a body of the printer and cannot be removed easily. Such a cleaning is needed relatively frequently. Further, such an upper transport path type apparatus generally has an image exposing system for projecting the image on the drum at a lower side of the drum. Further, development and cleaning systems are provided at both sides of the drum. Thus, when carrying out inspection of these systems, it is preferred to remove the drum from the body of the apparatus.

In removing the photosensitive body from the apparatus, there arises another problem in that such a removal requires a movement of the photosensitive drum body across the paper transport path passing above the drum and the removal of the jammed paper becomes difficult as the drum body tears the paper when the drum is removed in a state that there is a paper above the drum body. When the apparatus is designed such that the removal of the drum is made simultaneously with the opening of the top cover lid, such a tear of the paper as well as possible damaging of various parts of the system is inevitable. Thus, the conventional upper transport path type apparatus, though providing an easy access to the jammed paper has a problem in the removal or replacement of the drum body. Further, in association therewith, there is a difficulty in the maintenance and inspection of the apparatus

SUMMARY OF THE INVENTION

Accordingly, it is a general object of the present invention to provide a novel and useful xerographic image forming apparatus wherein the aforementioned problems are eliminated.

Another and more specific object of the present invention is to provide a xerographic image forming apparatus wherein removal of a photosensitive body used for transferring an image on a paper can be achieved easily without sacrificing easiness for removing jammed paper.

Another object of the present invention is to provide a xerographic image forming apparatus for transferring an image on a paper by exposing a photosensitive body to the image to produce a toner image and by transferring the toner image to the paper while passing the paper at an upper side of the photosensitive body, comprising: a top cover lid member provided above the photosensitive body so as to be opened and closed; movable supporting means provided on said top cover lid member so as to be movable between a first position and a second position relative to the top cover lid member, said movable supporting means being adapted for engagement with the photosensitive body and selectively assuming a first position in which the movable supporting means does not engage with the photosensitive body and a second position in which the movable supporting means engages with the photosensitive body responsive to opening of the top cover lid member; and fixed supporting means provided on a body of the xerographic image forming apparatus for supporting the photosensitive body. According to the present invention, the photosensitive body is removed from the body of the xerographic image forming apparatus responsive to the opening of the top cover lid member as long as the movable supporting means is in the second position, and the replacement of the photosensitive body is facilitated. In order to avoid tear of the jammed paper and associated damage to the apparatus by removing the photosensitive body, the movable supporting means is moved to the aforementioned first position when there is a jammed paper above the photosensitive body, and simultaneous removal of the photosensitive body responsive to the opening of the top cover lid is avoided. Thus, the user of the apparatus can select whether to leave the photosensitive body inside the apparatus or to remove it from the apparatus by setting the position of the movable supporting means. As a result, removal of the photosensitive body can be performed without obstructing the removal of the jammed paper. Further, inspection of the apparatus can be performed with efficiency by removing the photosensitive body.

Other objects and further features of the present invention will become apparent from the following detailed description when read in conjunction with attached drawings.

DETAILED DESCRIPTION

Figure 1:
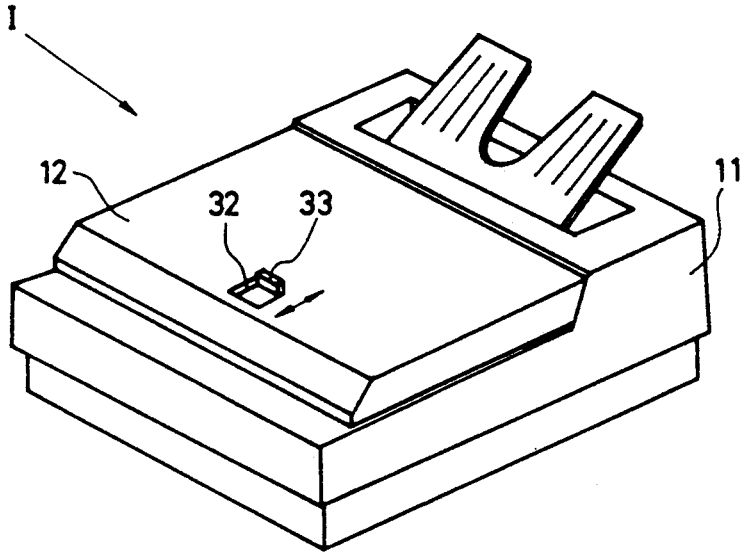
FIG. 1 is a perspective view showing a xerographic image forming apparatus according to an embodiment of the present invention.
Figure 2:
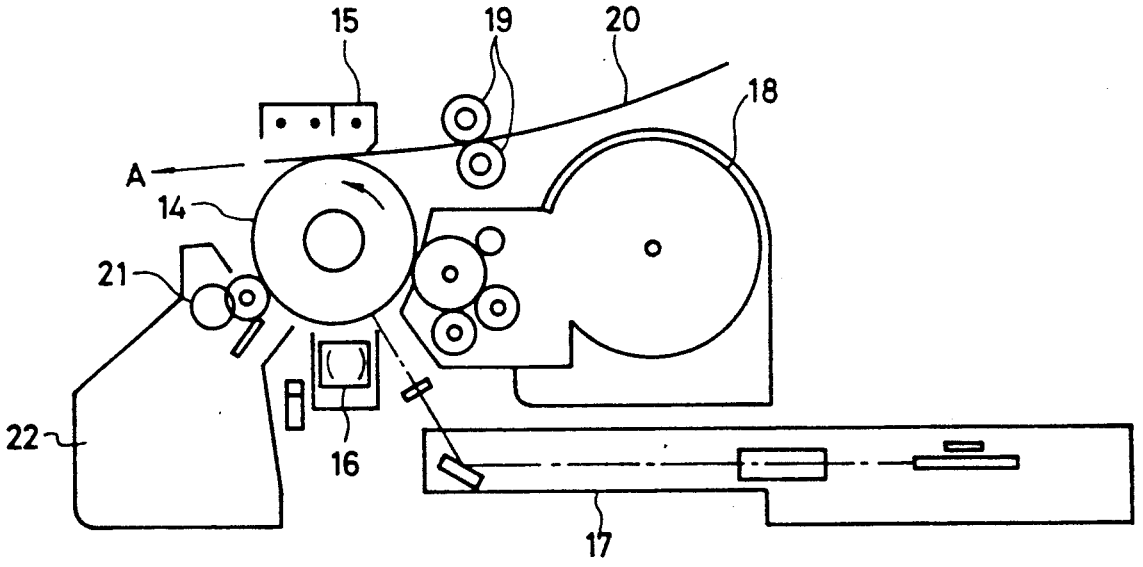
FIG. 2 is a diagram schematically showing a part of image transferring mechanism of the apparatus of FIG. 1.
Figure 3:
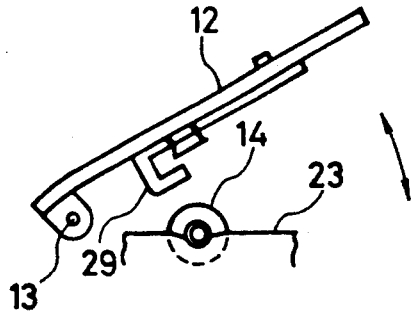
FIG. 3 is a diagram showing a top cover lid member used in the apparatus of FIG. 1 in a state that the top cover lid member is opened.

FIG. 1 shows a laser printer which is an embodiment of the xerographic image forming apparatus of the present invention. Referring to FIG. 1, the laser printer comprises a frame 11 and a top cover lid 12 mounted on the frame 11. The top cover lid 12 is held rotatably on the frame 11 by a shaft 13 as shown in FIG. 3 which is a partial view of the printer viewed from a side I shown in FIG. 1. Thus, when the lid 12 is lifted and rotated in a counterclockwise direction in FIG. 3, printer mechanism inside the printer frame 11 is exposed.

In the printer frame 11, there is a printer mechanism comprising a photosensitive drum body 14 acting as a photosensitive body having a photoconductivity, a transfer charger 15 provided above the drum body 14 and a charger 16 provided below the drum body 14. Further, a laser exposure system 17 and a development unit 18 are disposed around the drum body 14 between the transfer charger 15 and the charger 16 in sequence in the rotational direction of the drum body 14. When transferring a image on a paper, the drum body 14 is charged uniformly by the charger 16 while it is rotating in the counter clockwise direction. Further, the drum body 14 is exposed to the image to be transferred by the laser exposure system 17 and an electrostatic image is formed on the drum body 14. This electrostatic image is then developed by the developing unit 18 supplying a toner to the drum whereby a toner image is formed. The toner image is then transferred to a paper 10 under the action of the transfer charger 15 when the paper is contacted with the drum body 14 at the top side of the drum body 14. This paper 10 is fed from a paper cartridge not shown in the drawing by a resist roller 30 along a path passing above the drum body 14. After the transfer of the image, the paper 10 is separated from the drum body 14 and is transported in a direction indicated by an arrow A. The paper 10 then passes through a fixing part not illustrated in the drawing and is discharged from the printer. On the other hand, the toner remained on the drum body 14 after the transfer of the image is removed by a cleaner unit 21 and is recovered in a tank 22. It should be noted that the laser printer having such a construction exposes the drum to the image by irradiating a laser beam from a lower direction of the drum body 14 and the paper 10 is passed above the drum body 14.

Figure 4:
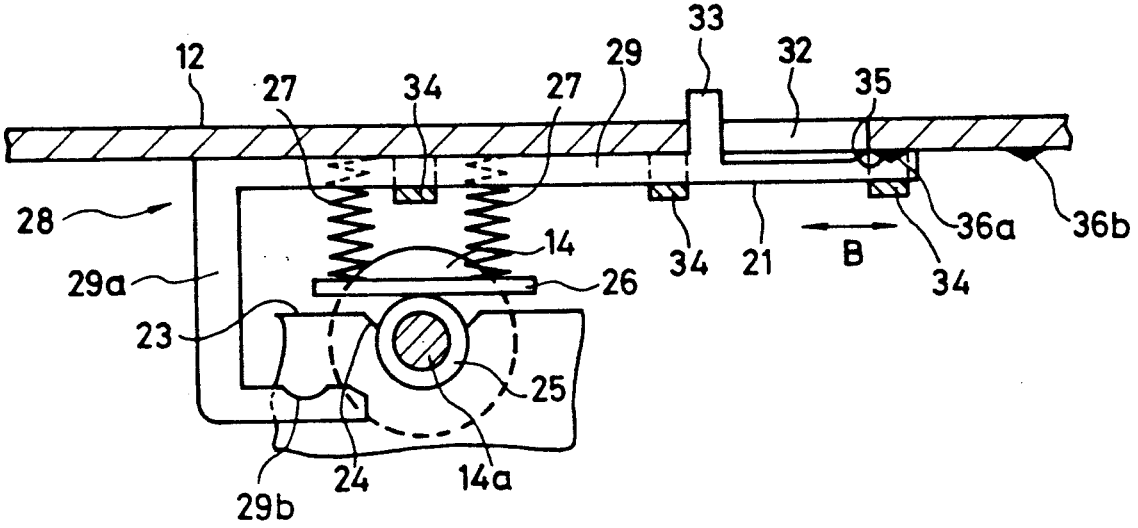
FIGS. 4 and 5 are partial cross sectional views showing supporting of a photosensitive body on a frame of the apparatus respectively in a state in which the photosensitive body is disengaged from a holder arm part provided on the top cover lid member for holding the photosensitive body and in a state in which the photosensitive body is engaged with the holder arm part.

FIG. 4 shows the drum body 14 in the printer. In this state, the drum is supported by a side plate 13 of the printer frame 11. It can be seen that the drum body 14 is engaged with a depression 24 formed in the side plate 13 acting as a drum supporting part. The drum body 14 has a shaft 14*a* and a bearing 25 is carried on the shaft 14*a*. It is this bearing 25 that is actually accepted in the depression 24. Thus, the depression 24 has a semi-circular shape in correspondence to the bearing 25. Further, the top cover lid 12 carries an urging plate 26 which is held thereon by a compressional spring 27 at a position to engage with the bearing 25 when the lid 12 is closed. When the lid 12 is closed, the urging plate 26 presses the bearing 25 towards the depression 24 and hence the drum body 14 is firmly held in the printer by the side plate 23.

Figure 5:
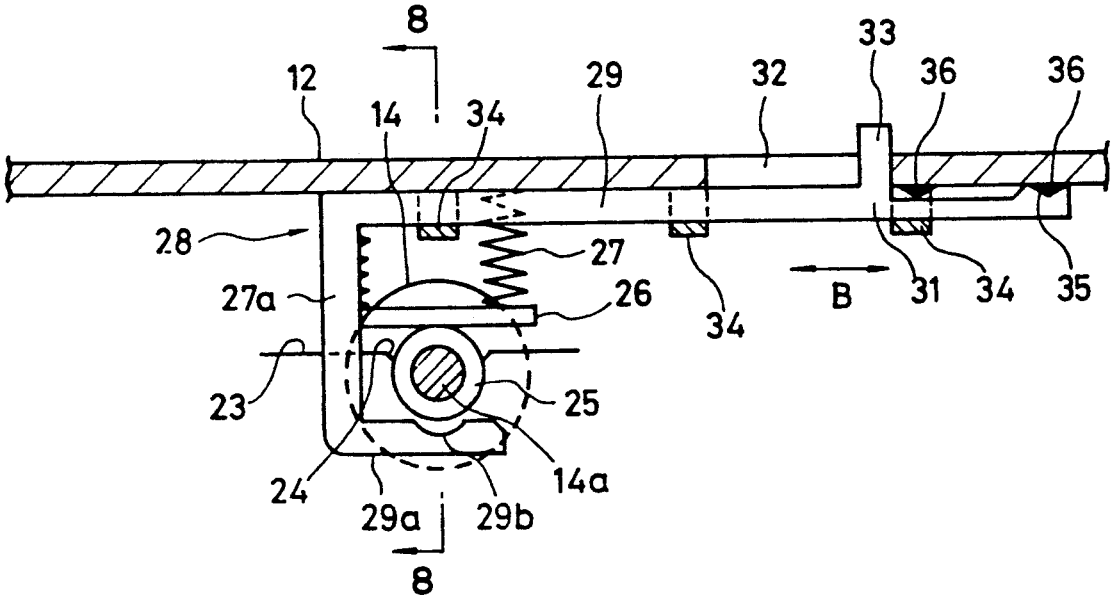
Figure 6:
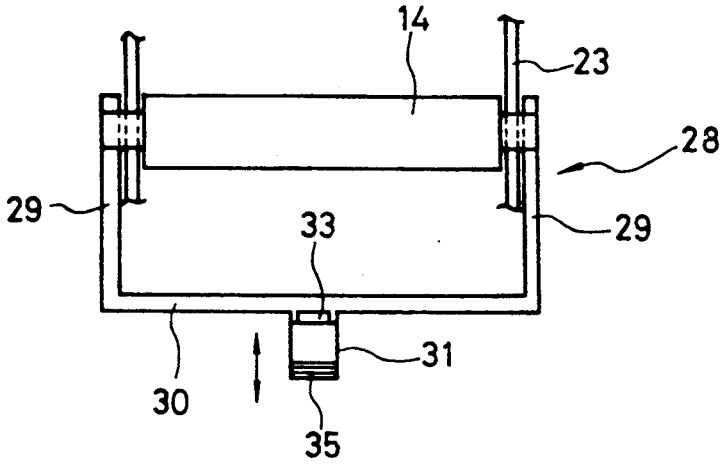
FIG. 6 is a plan view showing the general construction of the holder arm part.

The top lid cover 12 carries a movable drum supporting part constructed in a form of an arm member 28. As illustrated in FIGS. 4–6, the arm member 28 is formed in a generally U-shaped form and comprises a pair of leg portions 29 and a connecting rod 20 for connecting the both leg portions 29. Further, there is provided an actuating member 31 provided at a central part of the connecting rod 20. The leg portions 29, connecting rod 20 and the actuating member 31 are assembled unitarily or may be made from an integral body. The leg portion 29 has a finger 29*a* which is bent generally at a right angle and thus has a generally L-shaped form as shown in FIG. 4.

The arm member 28 is provided on a lower side of the top cover lid 12 by holding the leg portions 29 and the actuating member 31 by a mounting part 34 formed on the lower side of the top cover lid 12 as a part of the lid 12. More specifically, the leg portions 29 and the actuating member are passed through the mounting part 34 slidably. Further, there is defined an opening 32 having a size sufficient to accommodate a projecting part 33 of the actuating member 31, on the top cover lid 12 as shown in FIG. 1 and FIG. 4. This projecting part 33 acts as an actuation lever and by actuating the part 33 in the opening 32, the arm member 28 is slided relative to the top cover lid 12 with an extent determined by the size of the opening 32 and the actuation lever 33. FIG. 4 shows the state in which the actuation lever 33 is fully displaced to a position in contact with a left edge of the opening 32, and in this state, the arm member 28 is fully displaced in a left direction. Note that the finger 29*a* of the leg portion 29 of the arm member 28 is displaced from a region under the bearing 25 and the drum body 14 is held by the side plate 23 of the printer frame 11 by the engagement of the bearing 25 with the depression 24. In this state, there will be no removal of the drum body 14 when the top cover lid 12 is opened as shown in FIG. 3.

Figure 7:
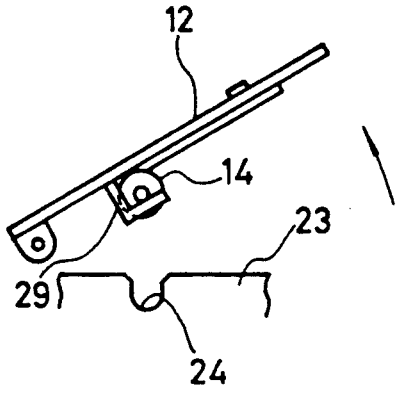
FIG. 7 is a view showing the top cover lid member together with the holder arm part and the photosensitive body held by the holder arm part in a state that the top cover lid member is opened.
Figure 8:
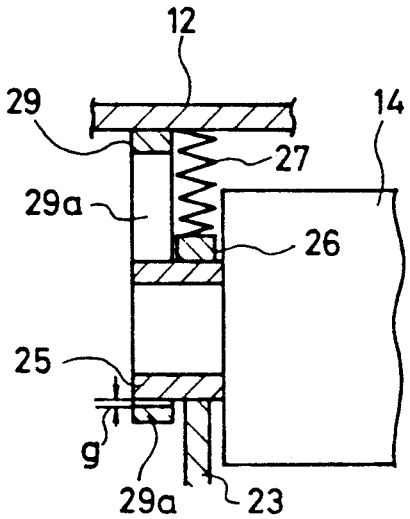
FIG. 8 is a cross sectional view showing a cross section taken along a VIII—VIII line of FIG. 5.

FIG. 5 shows a state in which the actuation lever 33 is moved fully in a right direction such that the lever 33 is engaged with a right edge of the opening 32. In this state, the arm member 28 is slided to the right relative to the top cover lid 12 and the finger 29*a* of the leg portion 29 proceeds to a region under the bearing 25. By lifting the top cover lid 12 and rotating it as shown in FIG. 7 in this state, the drum body 14 is removed from the printer frame 11 together with rotation of the cover lid 12. In order to avoid the displacement of the drum body 14 by the engagement with the finger 29*a* of the leg portion 29 in the state of FIG. 5 in which the drum body 14 is not yet removed from the printer, it is preferred to provide a small gap g between the bearing 25 and the finger 29*a* of the leg portion 29 as shown in FIG. 8.

FIGS. 4–6 show a catch mechanism comprising a pair of projections 36*a* and 36*b* provided on the top cover plate 12 and a corresponding depression 35 provided on a tip portion of the actuating member 31. When the arm member 28 is in the position shown in FIG. 4, the projection 36*a* close to the opening 32 is engaged with the depression 35 while in the position shown in FIG. 5, the projection 36*b* far from the opening 32 is engaged with the depression 35. In any of these positions, the arm member 28 is held stably and inadvertent movement of the drum body 14 during opening or closure of the top cover lid 14 is prevented.

When removing the paper 10 which is jammed in the vicinity of the transfer charger 15, the arm member 28 is moved to the position of FIG. 4 by actuating the lever 33. In this state, the finger 29*a* of the leg portion 29 is displaced from the part under the bearing 25 and the drum body 14 remains in the printer frame 11 in the state that the drum body 14 is supported by the side plate 23 of the printer frame 11 even when the top cover lid 12 is opened to remove the jammed paper 10.

When removing the drum body 14, on the other hand, the actuation lever 33 is pushed to the right as shown in FIG. 5 and the arm member 28 is moved to the position in FIG. 5 in which the finger 29*a* of the arm member is located under the bearing 25. By opening the top cover lid 12 in this state, the arm member 28 carries the drum body 14 away from the frame 11 of the printer and the mechanism of the printer is exposed. Thus, one can easily perform the replacement of defective drum body 14 or cleaning of the drum body 14. Further, as the drum body 14 is removed from the printer, inspection, cleaning and adjustment of the mechanism such as the charger 16, laser exposure system 17, development unit 18, cleaner unit 21, the tank 22 or the resist roller 19 shown in FIG. 1 can be made easily.

It should be noted that the apparatus of the present invention prevents the displacement of the drum body 14 during the removal from the printer by urging the bearing 25 to the finger 29*a* of the arm member 28 by the urging plate 26 which presses the bearing 25 to the finger 29*a* firmly. Thus, the undesirable and potentially dangerous displacement of the drum body 14 taking place on the arm member 28 during the removal from the printer which can cause serious damage to various parts of the printer as well as to the drum body itself is eliminated. Further, such a displacement is positively eliminated by providing a depression 29*b* on the finger 29*a* of the arm member 28 in correspondence to the shape of the bearing 25 as shown in FIGS. 4 and 5.

Further, the present invention is not limited to these embodiments but various variations and modifications may be made without departing from the scope of the present invention.

What is claimed is:

1. A xerographic image forming apparatus for transferring an image on a paper by exposing a photosensitive body to the image to produce a toner image and by transferring the toner image to the paper while passing the paper at an upper side of the photosensitive body, comprising:

a top cover lid member provided above the photosensitive body so as to be opened and closed;

movable supporting means provided on said top cover lid member so as to be movable between a first position and a second position relative to the top cover lid member, said movable supporting means being adapted for engagement with the photosensitive body and selectively assuming a first position in which the movable supporting means does not engage with the photosensitive body and a second position in which the movable supporting means engages with the photosensitive body responsive to opening of the top cover lid member; and fixed supporting means provided on a body of the xerographic image forming apparatus for supporting the photosensitive body.

2. A xerographic image forming apparatus as claimed in claim 1 in which said movable supporting means comprises a generally U-shaped arm member having a pair of leg portions and a connection part for connecting the leg portions at respective first ends of the leg portions, and said leg portions carry L-shaped fingers for engagement with the photosensitive body at respective second ends.

3. A xerographic image forming apparatus as claimed in claim 2 in which said leg portions and connection part extend generally parallel to the top cover lid member at a lower side thereof, and said L-shaped fingers are provided so as to hang down towards interior of the apparatus from said second ends of the leg portions.

4. A xerographic image forming apparatus as claimed in claim 2 in which said L-shaped finger is formed with a depression for receiving a part of the photosensitive body.

5. A xerographic image forming apparatus as claimed in claim 2 in which said top cover lid member carries a mounting member having a through hole on a lower surface, and said movable supporting means is held on said top cover lid member by passing the leg portions through the through hole of the mounting member.

6. A xerographic image forming apparatus as claimed in claim 2 in which said movable supporting means further comprises means for urging the photosensitive body to said L-shaped fingers.

7. A xerographic image forming apparatus as claimed in claim 6 in which said means for urging comprises a spring connected to a lower side of the top cover lid member and an urging plate connected at an end of the spring for contact with the photosensitive body.

8. A xerographic image forming apparatus as claimed in claim 3 in which said connecting part has a lever member projecting upwards in a direction away from said apparatus and said top cover lid has an opening for allowing projection of said lever member beyond said top cover lid member.

9. A xerographic image forming apparatus as claimed in claim 3 in which said connection part carries a stopper member and said top cover lid member carried first and second corresponding stop parts in correspondence to said first and second positions of said movable supporting means for stably holding the movable supporting means in said first and second positions.

10. A xerographic image forming apparatus as claimed in claim 9 in which said stopper member comprises a depression defined in the connection part and said first and second corresponding stop parts comprises a projection having a corresponding shape to that of the stopper member.

11. A xerographic image forming apparatus as claimed in claim 1 in which said movable supporting means is separated from the photosensitive body by a predetermined distance in said second position.

* * * * *